US012114708B2

(12) United States Patent
Li et al.

(10) Patent No.: US 12,114,708 B2
(45) Date of Patent: Oct. 15, 2024

(54) AEROSOL GENERATION SYSTEM, MEASUREMENT METHOD, ATOMIZATION DEVICE, AND POWER SUPPLY DEVICE

(71) Applicant: SHENZHEN FIRST UNION TECHNOLOGY CO., LTD., Shenzhen (CN)

(72) Inventors: Junjie Li, Shenzhen (CN); Zhongli Xu, Shenzhen (CN); Yonghai Li, Shenzhen (CN)

(73) Assignee: SHENZHEN FIRST UNION TECHNOLOGY CO., LTD., Shenzhen (CN)

( * ) Notice: Subject to any disclaimer, the term of this patent is extended or adjusted under 35 U.S.C. 154(b) by 416 days.

(21) Appl. No.: 17/753,311

(22) PCT Filed: Sep. 3, 2020

(86) PCT No.: PCT/CN2020/113258
§ 371 (c)(1),
(2) Date: Feb. 28, 2022

(87) PCT Pub. No.: WO2021/043215
PCT Pub. Date: Mar. 11, 2021

(65) Prior Publication Data

US 2022/0295901 A1 Sep. 22, 2022

(30) Foreign Application Priority Data

Sep. 3, 2019 (CN) ..... 201910827526.X

(51) Int. Cl.
*A24F 40/53* (2020.01)
*A24F 40/10* (2020.01)
(Continued)

(52) U.S. Cl.
CPC ..... *A24F 40/53* (2020.01); *A24F 40/10* (2020.01); *A24F 40/51* (2020.01); *A24F 40/60* (2020.01)

(58) Field of Classification Search
CPC ..... A24F 40/53; A24F 40/51; A24F 40/10
See application file for complete search history.

(56) References Cited

U.S. PATENT DOCUMENTS 9,532,600 B2 * 1/2017 Thorens ..... A24F 40/50
10,390,563 B2 * 8/2019 Hawes ..... F04B 19/006
(Continued)

FOREIGN PATENT DOCUMENTS

CN 103945716 A 7/2014
CN 204540813 U 8/2015
(Continued)

*Primary Examiner* — Neil Abrams
(74) *Attorney, Agent, or Firm* — Proi Intellectual Property US

(57) ABSTRACT

The present disclosure provides an aerosol generation system, a measurement method, an atomization device, and a power supply device. The aerosol generation system comprises: a liquid storage cavity, a vaporization element, a battery cell providing a power to the vaporization element, an air flow sensor for measuring an air flow inhalation velocity, and a controller. The controller is configured to determine the consumption of a liquid matrix in a time period on the basis of the power applied to the vaporization element, the air flow velocity, a correlation coefficient between the amount of aerosol generated and the power applied to the vaporization element, and a correction constant between the amount of aerosol generated and the air flow velocity in the time period. The use of the aerosol generation system can accurately estimate, measure, and/or predict the amount of the aerosol or the liquid matrix material delivered to a user.

20 Claims, 3 Drawing Sheets

(51) Int. Cl.
*A24F 40/51* (2020.01)
*A24F 40/60* (2020.01)

(56) References Cited

U.S. PATENT DOCUMENTS

| | | | | |
|---|---|---|---|---|
| 2016/0157524 | A1 | 6/2016 | Bowen et al. | |
| 2018/0360115 | A1 | 12/2018 | Lin et al. | |
| 2019/0008209 | A1 | 1/2019 | Bilat | |
| 2019/0261689 | A1 | 8/2019 | Bowen et al. | |
| 2019/0272359 | A1* | 9/2019 | Popplewell | G06F 21/32 |
| 2022/0022550 | A1* | 1/2022 | Beard | A24F 40/53 |
| 2022/0295901 | A1* | 9/2022 | Li | A24F 40/50 |

FOREIGN PATENT DOCUMENTS

| | | | |
|---|---|---|---|
| CN | 105473011 | A | 4/2016 |
| CN | 107105772 | A | 8/2017 |
| CN | 107373763 | U | 11/2017 |
| CN | 107397256 | A | 11/2017 |
| CN | 107647478 | A | 2/2018 |
| CN | 108143001 | A | 6/2018 |
| CN | 108601405 | A | 9/2018 |
| CN | 208286363 | U | 12/2018 |
| CN | 109152894 | A | 1/2019 |
| CN | 109497624 | A | 3/2019 |
| CN | 109924548 | A | 6/2019 |
| CN | 109963607 | A | 7/2019 |
| EP | 2468116 | A1 | 6/2012 |
| WO | 2016090303 | A1 | 6/2016 |
| WO | 2019104277 | A1 | 5/2019 |

* cited by examiner

AEROSOL GENERATION SYSTEM, MEASUREMENT METHOD, ATOMIZATION DEVICE, AND POWER SUPPLY DEVICE

CROSS REFERENCE TO RELATED APPLICATION(S)

This application claims priorities to Chinese Patent Applications entitled "Aerosol generation system, measurement method, atomization device, and power supply device" with application number of 201910827526.X, submitted to China National Intellectual Property Administration on Sep. 3, 2019, the entire contents of which are incorporated herein by reference.

TECHNICAL FIELD

The present disclosure relates to the technical field of electronic cigarettes, and in particular to an aerosol generation system, a measurement method, an atomization device, and a power supply device.

BACKGROUND

As an example of an electronic cigarette product, there exists an aerosol providing device, for example, the so called electronic cigarette device. These devices generally contain a liquid, which is heated to be vaporized to generate an inhalable aerosol. The liquid may contain nicotine and/or fragrances and/or aerosol-generating substances (e.g., glycerin).

So far, attempts to determine the dosage of active ingredients in an aerosol have not been satisfactory, and it is impossible to control partial dosage inhaled after vaporization. These types of systems can also measure the amount of the liquid material and need to accurately measure the mass and/or volume of the liquid material that is conveyed for vaporization, or measure the difference between the initial mass/volume and the remaining mass or volume after vaporization. These measurements may be difficult, need high precision and cost, and may lead to inaccurate results.

What is needed is a method and device for inhaling an aerosol and accurately inhaling a dosage, for example, within a proper precision/error range. In particular, those methods and devices which determine the inhalation amount of aerosol by monitoring the electrical activities of the device and monitoring in some cases the working power of the device (through electrical estimation or direct measurement) are helpful. In addition, those methods and devices which provide a preset dosage of inhalation and/or give a prompt to the user or maintenance personnel when the dosage threshold is reached or exceeded are helpful. In addition, electronic records which provide the inhalation amount of aerosol are helpful too.

SUMMARY

In order to solve the problem of precise detection of the inhalation amount of aerosol in the prior art, the embodiment of the present disclosure provides an aerosol generation system which can estimate, measure, and/or predict the amount of the aerosol or the liquid substrate material delivered to a user, and a method of use thereof.

One embodiment of the present disclosure provides an aerosol generation system, including:

a liquid storage cavity, which is configured for storing a liquid substrate;

a vaporization element, which is configured for vaporizing the liquid substrate to form an aerosol for a user to inhale;

a battery cell, which is configured for providing a power to the vaporization element;

an air flow sensor, which is configured for measuring an air flow velocity formed by user inhalation passing through the aerosol generation system; and a controller, which is configured for determining the consumption of the liquid substrate in a time period on the basis of the power applied to the vaporization element, the air flow velocity, a correlation coefficient and a correction constant in the time period; wherein the correlation coefficient is a coefficient of correlation between the power applied to the vaporization element and the amount of aerosol generated, and the correction constant is a modified value for correlation between the air flow velocity passing through the aerosol generation system and the amount of aerosol generated.

In a more preferred embodiment, the time period includes multiple unit time lengths;

the controller is configured for:

calculating the air flow passing through the aerosol generation system per unit time length through the air flow velocity;

calculating the amount of aerosol generated in the unit time length through the power applied to the vaporization element, the correlation coefficient and the correction constant in the unit time length; and calculating the consumption of the liquid substrate in the time period through the amount of aerosol generated and the air flow in the unit time length.

In a more preferred embodiment, the controller is configured for determining the consumption of the liquid substrate in the time period according to the following formula:

$$M_{consumption} = \sum_{t=0}^{n} \binom{n}{t} [(a \times Pf + k) \times Vt \times S],$$

where $M_{consumption}$ is the consumption of the liquid substrate in the time period, Pf is the power applied to the vaporization element in a unit time length, a is the correlation coefficient, k is the correction constant, Vt is the air flow velocity passing through the aerosol generation system, S is a constant, t is time, n is a number of unit time lengths included in the time period.

In a more preferred embodiment, the controller is further configured for estimating the remaining amount of the liquid substrate inside the liquid storage cavity on the basis of the determined consumption of the liquid substrate.

In a more preferred embodiment, the controller is configured for estimating the remaining amount of the liquid substrate inside the liquid storage cavity by subtracting the consumption from the known initial amount of the liquid substrate stored in the liquid storage cavity.

In a more preferred embodiment, the aerosol generation system further includes:

an information memory unit, which stores calculation constant information, the calculation constant information including the correlation coefficient information and the correction constant information; and an information acquisition unit, which is configured for receiving the calculation constant information stored in the information memory unit and thus acquiring the correlation coefficient or the correlation constant.

In a more preferred embodiment, the correlation coefficient information includes the correlation coefficient or a physical and chemical parameter of the liquid substrate associated to the correlation coefficient; and the information acquisition unit is configured for receiving the correlation coefficient information and thus acquiring the correlation coefficient or the physical and chemical parameter of the liquid substrate associated to the correlation coefficient.

In a more preferred embodiment, the controller stores a comparison table between the correlation coefficient and the physical and chemical parameter of the liquid substrate, and is configured for retrieving the correlation coefficient from the comparison table according to the physical and chemical parameter of the liquid substrate.

In a more preferred embodiment, the physical and chemical parameter includes at least one of the substance composition, viscosity, specific heat or vaporization efficiency of the liquid substrate.

In a more preferred embodiment, the information memory unit includes at least one of EPROM, EEPROM, NFC label, bar code and QR code.

In a more preferred embodiment, the information memory unit further stores the known initial amount of the liquid substrate stored in the liquid storage cavity.

In a more preferred embodiment, the aerosol generation system further includes an output device, which is configured for indicating the consumption of the liquid substrate in the time period or presenting the remaining amount of the liquid substrate inside the liquid storage cavity.

In a more preferred embodiment, the vaporization element includes at least one heating element, which is configured for heating the liquid substrate to form an aerosol; and the aerosol generation system further includes: a capillary core, which is configured for conveying the liquid substrate to the heating element from the liquid storage cavity.

Another embodiment of the present disclosure provides a measurement method of an aerosol generation system for consumption of a liquid substrate, wherein the aerosol generation system includes:

a liquid storage cavity, which is configured for storing a liquid substrate;

a vaporization element, which is configured for vaporizing the liquid substrate to form an aerosol for a user to inhale;

a battery cell, which is configured for providing a power to the vaporization element;

an air flow sensor, which is configured for measuring an air flow velocity formed by user inhalation passing through the aerosol generation system; and wherein the method includes a step of: determining the consumption of the liquid substrate in a time period on the basis of the power applied to the vaporization element, the air flow velocity, a correlation coefficient and a correction constant in the time period; wherein the correlation coefficient is a coefficient of correlation between the power applied to the vaporization element and the amount of aerosol generated, and the correction constant is a modified value for correlation between the air flow velocity passing through the aerosol generation system and the amount of aerosol generated.

In a more preferred embodiment, the time period includes multiple unit time lengths; and the method includes:

calculating the air flow passing through the aerosol generation system per unit time length through the air flow velocity;

calculating the amount of aerosol generated in the unit time length through the power applied to the vaporization element, the correlation coefficient and the correction constant in the unit time length; and calculating the consumption of the liquid substrate in the time period through the vaporization amount of the liquid substrate and the air flow in the unit time length.

In a more preferred embodiment, the method includes:

determining the consumption of the liquid substrate in the time period according to the following formula:

$$M_{consumption} = \sum_{t=0}^{n} \binom{n}{t} [(a \times Pf + k) \times Vt \times S],$$

where $M_{consumption}$ is the consumption of the liquid substrate in the time period, Pf is the power applied to the vaporization element in a unit time length, a is the correlation coefficient, k is the correction constant, Vt is the air flow velocity passing through the aerosol generation system, S is a constant, t is time, n is a number of unit time lengths included in the time period.

In a more preferred embodiment, the aerosol generation system further includes an information memory unit which stores calculation constant information, the calculation constant information including at least one of the correlation coefficient information or the correction constant information; and the method includes: receiving the calculation constant information stored in the information memory unit and thus acquiring the correlation coefficient or the correlation constant.

In a more preferred embodiment, the correlation coefficient information includes the correlation coefficient or a physical and chemical parameter of the liquid substrate associated to the correlation coefficient; and the method includes:

receiving the correlation coefficient information stored in the information memory unit and thus acquiring the correlation coefficient; or receiving the correlation coefficient information stored in the information memory unit and thus acquiring the physical and chemical parameter of the liquid substrate associated to the correlation coefficient, and deducing the correlation coefficient according to the physical and chemical parameter of the liquid substrate.

In a more preferred embodiment, the physical and chemical parameter of the liquid substrate includes at least one of the substance composition, viscosity, specific heat, boiling point or vaporization efficiency of the liquid substrate.

One embodiment of the present disclosure further provides an atomization device, including:

a liquid storage cavity, which is configured for storing a liquid substrate;

a vaporization element, which is configured for vaporizing the liquid substrate when a power is applied, so to form an aerosol for a user to inhale;

an air flow sensor, which is configured for measuring an air flow velocity formed by user inhalation passing through the atomization device; and an information memory unit, which stores calculation constant information, the calculation constant information including correlation coefficient information and correction constant information; wherein by receiving the calculation constant information stored in the information memory unit, the correlation coefficient or the correlation constant can be acquired, thus the consumption of the liquid substrate in a time period can be determined according to the power applied to the vaporization element, the air flow velocity, the correlation coefficient and the correction constant in the time period; wherein the correlation coefficient is a coefficient of correlation between the power applied to the vaporization element and the amount of aerosol generated, and the correction constant is a modified value for correlation between the air flow velocity passing through the atomization device and the amount of aerosol generated.

In a more preferred embodiment, the information memory unit includes at least one of EPROM, EEPROM, NFC label, bar code and QR code.

In a more preferred embodiment, the correlation coefficient information includes the correlation coefficient or a physical and chemical parameter of the liquid substrate associated to the correlation coefficient; wherein the physical and chemical parameter of the liquid substrate includes at least one of the substance composition, viscosity, specific heat, boiling point or vaporization efficiency of the liquid substrate.

One embodiment of the present disclosure further provides a power supply device matched with an atomization device, which is configured for applying a power to the atomization device so that the atomization device vaporizes a liquid substrate to form an aerosol for a user to inhale; wherein the atomization device includes an air flow sensor which is configured for measuring an air flow velocity formed by user inhalation passing through the atomization device; wherein the power supply device includes:

a battery cell, which is configured for applying a power to the atomization device;

a controller, which is configured for determining the consumption of the liquid substrate in a time period on the basis of the power applied to the vaporization element of the atomization device, the air flow velocity, a correlation coefficient and a correction constant in the time period; wherein the correlation coefficient is a coefficient of correlation between the power applied to the vaporization element and the amount of aerosol generated, and the correction constant is a modified value for correlation between the air flow velocity passing through the atomization device and the amount of aerosol generated.

In a more preferred embodiment, the atomization device includes an information memory unit, which stores calculation constant information, the calculation constant information including the correlation coefficient information and the correction constant information; and the power supply device further includes:

an information acquisition unit, which is configured for receiving the calculation constant information stored in the information memory unit and thus acquiring the correlation coefficient and the correlation constant.

With the above aerosol generation system, the amount of the aerosol or the liquid substrate material delivered to a user can be accurately estimated, measured, and/or predicted, according to the power factors related to the amount of aerosol generated during the process of inhalation and the air flow factors related to the construction, in conjunction with the power applied to the vaporization element and the method to measure the air flow velocity.

BRIEF DESCRIPTION OF THE DRAWINGS

One or more embodiments are illustrated through the image(s) in corresponding drawing(s). These illustrations do not form restrictions to the embodiments. Elements in the drawings with a same reference number are expressed as similar elements, and the images in the drawings do not form restrictions unless otherwise stated.

DETAILED DESCRIPTION

For a better understanding of the present disclosure, the present disclosure is described below in further detail in conjunction with accompanying drawings and specific embodiments.

The present disclosure provides a method and a device, including a device and a system for estimating, measuring and/or predicting the amount of the aerosol or the liquid substrate material that can be delivered to a user. Particularly, what is described in this paper is an aerosol generation system and a method of use thereof, which determine the amount of the aerosol or the liquid substrate material mainly or completely based on an electric energy, for example, a power or energy applied to a heating element (for example, resistor heating element). In some variants, the amount of the liquid substrate material that is heated and vaporized can be estimated based on the electrical performances of the heating element.

The present disclosure provides a detection method of an aerosol generation system for the consumption of a liquid substrate, including measuring the amount of the liquid substrate material that is vaporized from the aerosol generation system, according to the power, the time, the air flow inhalation velocity, and a calculation coefficient relevant to the vaporization efficiency of the liquid substrate. These methods and devices may include a system for predicting an amount (for example, mass, volume, etc.) of a liquid substrate, which includes building a function relationship between the total amount of aerosol and the power, the time, the air flow inhalation velocity, the calculation coefficient relevant to the liquid substrate vaporization efficiency.

Generally, the power may refer to an output power that is used for heating and vaporizing a liquid substrate material. The applied power may be directly read from the controller and/or detected (for example, Watt, joule, joule/second$^2$, volt×volt/resistance, etc.), for example, employing any appropriate power sensor (voltmeter, Hall effect sensor, inductive sensor, direct measurement sensor, voltage response measurement sensor, etc.).

The liquid substrate suitable for one embodiment of the present disclosure may include nicotinic/nicotinic salts, glycerol and propylene glycol.

Figure 1:
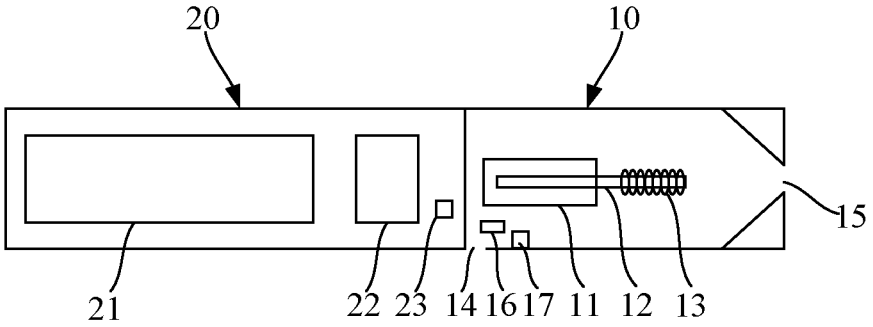
FIG. 1 is a diagram of an aerosol generation system according to one embodiment.

FIG. 1 is a diagram of an aerosol generation system according to one embodiment. The aerosol generation system includes an atomization device 10 and a power supply device 20 that are in detachable connection. The atomization device 10 stores a liquid substrate, and can receive a power from the power supply device 20 to vaporize the liquid substrate so as to generate an aerosol for inhalation. In some variants, the above atomization device 10 and the power supply device 20 may be integrated. Description is provided below taking the aerosol generation system shown in FIG. 1 for example.

The atomization device 10 includes:

a liquid storage cavity 11, which stores a vaporizable liquid substrate;

a capillary core 12, one end of which extends into the liquid storage cavity 11 and the other end is enclosed by a heating element 13, as shown in FIG. 1;

an air inlet 14, which is configured for allowing air to enter during the process of inhalation; an air outlet 15, through which a user inhales; wherein between the air inlet 14 and the air outlet 15 inside the atomization device 10 is formed an airflow channel for airflow communication, so as to form an airflow circulation during the process of inhalation;

an air flow sensor 16, which is arranged in the airflow channel between the air inlet 14 and the air outlet 15 to measure an air flow velocity formed by user inhalation and thus control the atomization device 10 to operate according to the inhalation.

The power supply device 20 includes:

a battery cell 21 which is configured for providing a power, and a controller 22, wherein the controller 22 is configured for controlling the battery cell 21 to provide an electric energy to the heating element 13 according to a detection signal of the air flow sensor 16, so as to enable the atomization device 10 to operate.

During usage, the liquid substrate inside the liquid storage cavity 11 is conveyed, through the capillary action, from one end part of the capillary core 12 extended into the liquid storage cavity 11 to the other end part enclosed by the heating element 13. When a user inhales at the air outlet 15, the surrounding air is inhaled through the air inlet 14, then the air flow sensor 16 senses the air flowing caused by inhalation to generate a sensing signal, thus the controller 22 controls the battery cell 21 to output an electric energy to the heating element 13 according to the sensing signal, such that the heating element 13 heats the end part of the capillary core 12 enclosed by the heating element 13 and that the liquid substrate inside this end part of the capillary core 12 is vaporized to generate an aerosol for inhalation.

In one variant embodiment, in order to ensure that the air flow velocity collected by the air flow sensor 16 can accurately represent an inhalation action, it is needed to set a threshold during implementation, which is expressed by Gf; when the air flow velocity collected by the air flow sensor 16 is greater than the threshold Gf, the controller 22 controls the battery cell 21 to output a power to the heating element 3; when the air flow velocity collected by the air flow sensor 16 is lower than the threshold Gf, the controller 22 disconnects the power output.

Or, in other variants, the atomization device 10 can also vaporize the liquid substrate to generate an aerosol for inhalation employing ultrasonic, spraying and other ways, instead of employing the heating and vaporization way of the heating element 13.

In one embodiment, the controller 22 is configured for controlling the magnitude of the electrical energy output by the battery cell 21 to the heating element 13, according to the air flow velocity value detected by the air flow sensor 16.

Specifically, for example, in another embodiment, the controller 22 is provided with a comparison table or curve on which an air flow inhalation velocity is corresponding to an output power, and the controller 22 controls the output of power according to the relationship between the air flow velocity and the output power on the comparison table or curve. For example, in one embodiment, the bigger the air flow velocity value, which indicates the greater the inhalation force of the user inhalation, the higher the output power controlled by the controller 22, and the more the generated aerosol.

Another example, in another embodiment, the controller 22 is configured for controlling the output of power according to a linear relationship between the air flow velocity and the output power within the range between preset maximum and minimum values of the air flow velocity; when the air flow velocity detected by the air flow sensor 16 is greater than the maximum value, the controller 22 controls the battery cell 21 to output a power according to the actual power that can be output, which on one hand can prevent the power rising unlimitedly according to the increase of the air flow velocity to cause high-temperature safety risk, and on the other hand can ensure the output power to be within the power range that can be output by the electric capacity of the battery cell 21. Or course, if the air flow velocity is lower than the minimum value, it may be considered that the air flowing is erroneously triggered by other incidents, rather than by inhalation, and the controller 22 controls the battery cell 21 not to output a power.

In another embodiment, the atomization device 10 further includes an information memory unit 17, wherein the information memory unit 17 is at least one of NFC label, EPROM, EEPROM, bar code and QR code. In addition, the information stored in the EPROM, EEPROM, NFC label, bar code or QR code serving as the information memory unit 17 includes information about the liquid substrate inside the liquid storage cavity 11, wherein the information about the liquid substrate includes remaining amount information of the liquid substrate stored in the liquid storage cavity 11, for example, remaining mass, volume, molar weight, or puff number, etc.

In one embodiment, an information acquisition unit 23 includes a scanning device (for example, a bar code scanning gun) having a scanning function, which collects the information provided by the bar code or QR code by scanning the bar code or QR code on the atomization device 10. In a preferred embodiment, the scanning device is configured for scanning by emitting an infrared wavelength light or ultraviolet wavelength light.

In another embodiment, an information acquisition unit 23 includes an NFC sensor based on near-field communication technologies; of course, this NFC sensor is one that can receive a radio signal within a receivable distance range. When the NFC label of the atomization device 10 is within the above distance range, the NFC sensor can receive a radio signal emitted by the NFC label, and can read the liquid substrate information stored in the NFC label through the received radio signal.

In one embodiment, the information memory unit 17 is arranged on an outer surface of the atomization device 10, meanwhile the information acquisition unit 23 of the power supply device 20 is arranged on an outer surface near the information memory unit 17 or a corresponding near position.

Figure 2:
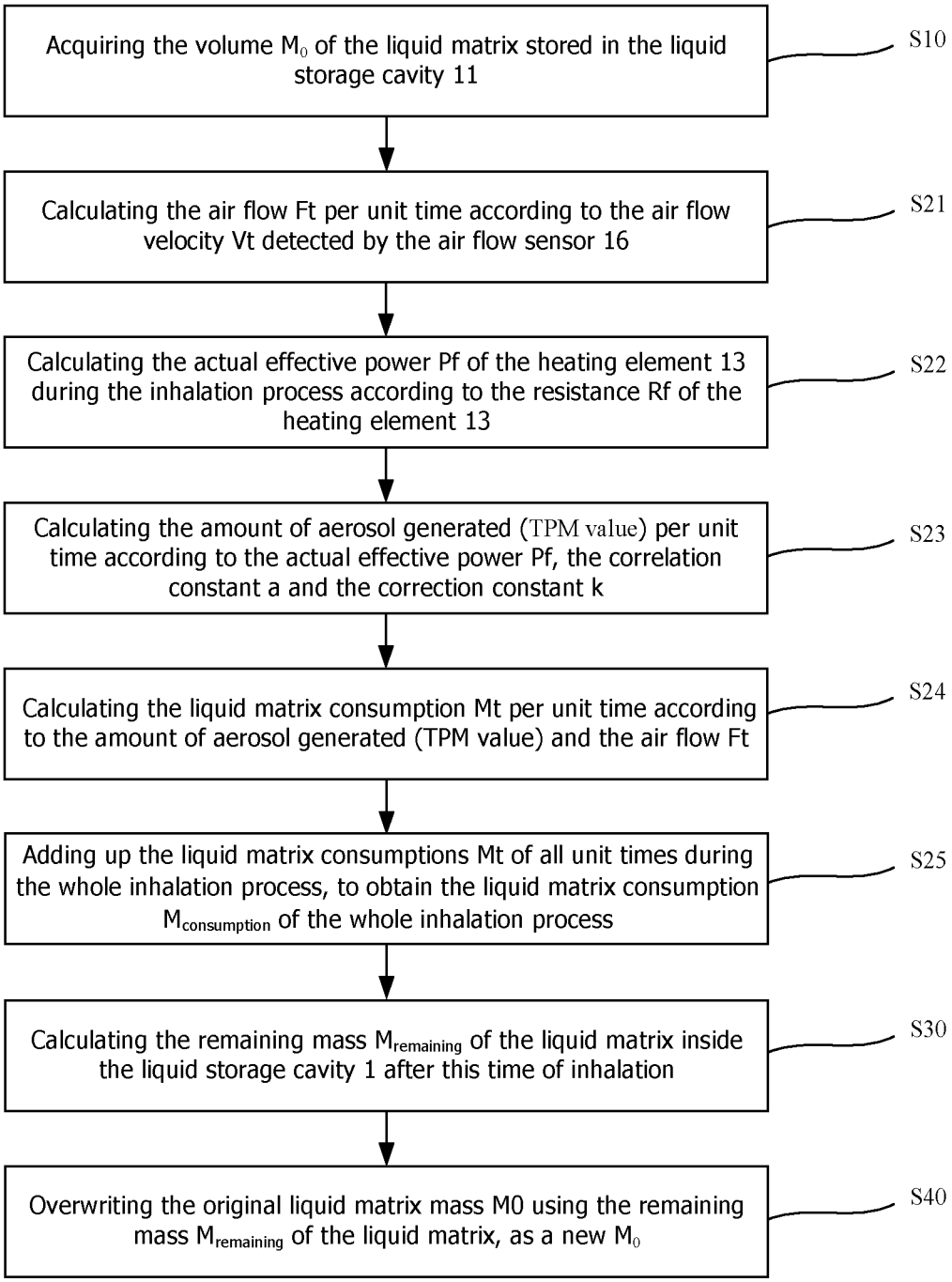
FIG. 2 is a diagram of a measurement method for consumption of a liquid substrate according to one embodiment.

In another embodiment, the controller 22 is configured for determining the total dosage of aerosol inhaled in an inhalation time period, on the basis of an air flow velocity detected by the air flow sensor 16, a power output by the battery cell 21 to the heating element 13, a correlation coefficient a between the amount of aerosol generated through vaporization of the liquid substrate and the above power, a correction constant k for correlation between the amount of aerosol generated through vaporization of the liquid substrate and the above air flow velocity, and the inhalation time period, and thus indicating to the user the amount of aerosol inhaled or calculating the remaining amount of the liquid substrate inside the liquid storage cavity 11 after the inhalation. Specifically, in one embodiment, as shown in FIG. 2, a method for measuring the remaining amount of the liquid substrate inside the liquid storage cavity 11 after the inhalation includes the following steps:

S10: receiving the liquid substrate information stored in the information memory unit 17 (for example, NFC label) through the information acquisition unit 23 (for example, NFC sensor), thereby acquiring the mass $M_0$ of the liquid substrate stored in the liquid storage cavity 11.

S20: calculating the liquid substrate consumption mass Mt during the inhalation process, wherein the specific process may include:

S21: calculating the air flow Ft per unit time according to the air flow velocity Vt detected by the air flow sensor 16; Ft=S×Vt, where S is the cross section area of the air channel of the atomization device 10, and Vt is the air flow velocity detected by the air flow sensor 16 passing through the atomization device 10.

S22: calculating the actual effective power Pf of the heating element 13 per unit time during the inhalation process according to the resistance Rf of the heating element 13.

$Pf=Rf\times P_{output}/R$, where $P_{output}=U\times U/R$, where U is the output voltage of the battery cell 21, R is the load resistance of the whole circuit, and Rf is the resistance of the heating element 13.

S23: calculating the amount of aerosol generated per unit time according to the actual effective power Pf of the heating element 13 and the air flow Ft, that is, TMP value; wherein the amount of aerosol is expressed by a TPM (Total Particulate Matter) value that is commonly employed in the field, and the TPM value generally is calculated and expressed by the mass of aerosol particles per unit volume.

Calculation equation: $TPM=a\times Pf+k$.

The efficiency of generation of aerosol during the inhalation process is mainly affected by a power and a flow velocity; the correlation coefficient a and the correction constant k are calculation parameters related to the power and the flow velocity respectively; for a given aerosol generation system that is manufactured and prepared, the correlation coefficient a is constant and measurable; factors of the correlation coefficient a are the shape and construction of the aerosol generation system, the structure parameters of the capillary core 12 and the heating element 13, the physical and chemical parameters of the liquid substrate, especially the vaporization efficiency, etc. The correction constant k is related to the shape, construction and the like of the air flow channel of the aerosol generation system, and the air flow velocity during the inhalation, and also is computable.

In the above computation equation, the correlation coefficient a is mainly a multiple coefficient of correlation between the amount of aerosol generated TPM and the effective power Pf of the heating element 13; the correction constant k is mainly a modified value for the amount of aerosol generated by the atomization device 10 of a given structure at a changed inhalation flow velocity.

S24: calculating the liquid substrate consumption Mt per unit time according to the amount of aerosol generated (TPM value) per unit time acquired in S23 and the air flow Ft acquired in S21. Mt=TPM×Ft.

S25: adding up the liquid substrate consumption Mt per minimum unit time during the whole inhalation process, to obtain the liquid substrate consumption $M_{consumption}$ of the whole inhalation process:

$$M_{consumption}=\sum_{t=0}^{n}\binom{n}{t}[(a\times Pf+k)\times Vt\times S],$$

where n is the number of unit times included in the whole inhalation process, and during actual calculation n is generally calculated by the high-level signal duration triggered by the air flow sensor 16.

It is to be noted that, for a given aerosol generation system that is manufactured and prepared, the cross section area S involved in S20, the resistance Rf of the heating element 13, the load resistance R of the whole circuit are all constants and measurable; although the output voltage U decreases as the discharge time prolongs, it is still known and measurable. Therefore, to finally simplify the formula, the air flow Ft may be replaced by Vt multiplied by cross section area S and then is put into the formula to obtain a formula as follows:

$$M_{consumption}=\sum_{t=0}^{n}\binom{n}{t}[(a\times Pf+k)\times Ft]=\sum_{t=0}^{n}\binom{n}{t}[(a\times Pf+k)\times Vt\times S]$$

Since the cross section area S is a fixed coefficient, it may be combined into the correlation coefficient a and the correction constant k.

After the above steps are finished, the method may further include:

S30: calculating the remaining mass $M_{remaining}$ of the liquid substrate inside the liquid storage cavity 1 after this time of inhalation. $M_{remaining}=M_0-M_{consumption}$.

In addition, to facilitate the calculation of the remaining amount of a next time of inhalation, the method may further include:

S40: sending the remaining mass $M_{remaining}$ of the liquid substrate inside the liquid storage cavity 1 after this time of inhalation to the information memory unit 17 to replace or overwrite the originally stored current mass $M_0$ data of the liquid substrate, as a new $M_0$.

It is to be noted that the above embodiment is an example to calculate the consumption mass of the liquid substrate during the inhalation process; in similar methods, it may calculate the consumption volume of the liquid substrate during the inhalation process.

In another embodiment, the aerosol generation system further includes an output device which is configured for presenting the amount of the liquid substrate inhaled by the user during the inhalation time period or the remaining amount of the liquid substrate stored in the liquid storage cavity 11. Any appropriate output device may be employed, including video display, LED, loudspeaker, radio transmitter, etc.

In another embodiment, the resistance value of the heating element 13 needed in S22 may be designed to be stored in the information memory unit 17, then the information acquisition unit 23 communicates with the information memory unit 17 to receive the resistance value information of the heating element 13, thereby acquiring the resistance value Rf of the heating element 13.

Or, in a more preferred embodiment, the power supply device 20 further includes a resistance value detection module (not designated by a number in figures) which is configured for detecting the resistance value of the heating element 13. The specific implementation of the resistance value detection module may employ a voltage-dividing circuit formed by a series connection of a divider resistor and the heating element 13, and then detect the voltage divided by the divider resistor to calculate the resistance value of the heating element 13. Or, in other variant embodiments, the method for detection of the resistance value is as the detailed description of the specification 201921036660.X. By acquiring the resistance value Rf of the heating element 13, a precise calculation of power and vaporization efficiency may be realized.

In a more preferred embodiment, in order to facilitate the controller 22 to calculate the amount of aerosol generated during the inhalation process, the above needed correlation coefficient a and/or correction constant k can also be stored in the information memory unit 17.

Meanwhile, in one embodiment, the correlation coefficient a and/or correction constant k can be directly stored in the information memory unit 17, then the information acquisition unit 23 can acquire the above coefficient by reading or receiving the correlation coefficient a and/or correction constant k stored in the information memory unit 17.

Of course, in the production and preparation of products, for atomization devices 10 of the same product model, the shape construction, the capillary core 12 and the heating element 13, the area of the air flow channel and the like are fixed and constant; therefore, in common implementation, the above correlation coefficient a which affects the power and the consumption of the liquid substrate is determined only by the properties of the liquid substrate infilled and is measurable.

Further, the physical and medical parameter of the liquid substrate which is related to the correlation coefficient a includes at least one of density, viscosity, specific heat, vaporization efficiency, substance composition and the like. Therefore, after these parameters are obtained, the correlation coefficient a can be deduced or calculated according to the information of these parameters.

In another embodiment, the controller 22 stores a comparison table between the physical parameters of the liquid substrate and the correlation coefficient a; after acquiring the physical parameters stored in the information memory unit 17 through the information acquisition unit 23, the controller 22 can inquire and acquire the corresponding correlation coefficient a from the comparison table to calculate the consumption of the liquid substrate.

Of course, or, in other embodiments, it is possible to measure the above correlation coefficient a by a user; hereinbelow is provided a process in a specific embodiment to detect the correlation coefficient a of an atomization device 10 which is manufactured and prepared, wherein the liquid storage cavity 11 of the atomization device 10 in this specific embodiment originally stores 37.561 g of liquid substrate, the initial output voltage of the power supply device 20 is 4.0 volt, and the resistance value of the heating element 13 is 1.5 ohm, then the process to measure the relationship between the TPM value and the power is as follows:

S231: inhaling at a constant air flow inhalation velocity, wherein in the specific embodiment, the air flow inhalation velocity is constantly kept at 17.5 mL/s, each process of inhalation includes 10 puffs, and each puff lasts 3 s.

S232: measuring the mass reduction of the atomization device 10 between before and after each process of inhalation under the above setting, and then converting it into a TPM value of the aerosol generated in each puff; meanwhile, detecting the output voltage change of the battery cell 21 between before and after each process of inhalation to calculate the power of the heating element 13; wherein the measurement data of 40 processes of inhalations is as the following table.

| Serial number | Mass before inhalation g | Mass after inhalation g | Weight difference g | Mass of each puff mg | Initial voltage V | End voltage V | Voltage difference V | Power W |
|---|---|---|---|---|---|---|---|---|
| 1 | 37.561 | 37.521 | 0.040 | 4.000 | 4.00 | 3.99 | 0.01 | 10.64 |
| 2 | 37.521 | 37.480 | 0.041 | 4.100 | 3.99 | 3.96 | 0.03 | 10.53 |
| 3 | 37.480 | 37.439 | 0.041 | 4.100 | 3.98 | 3.95 | 0.03 | 10.48 |
| 4 | 37.439 | 37.400 | 0.039 | 3.900 | 3.97 | 3.93 | 0.04 | 10.40 |
| 5 | 37.400 | 37.359 | 0.041 | 4.100 | 3.94 | 3.91 | 0.03 | 10.27 |
| 6 | 37.359 | 37.320 | 0.039 | 3.900 | 3.93 | 3.89 | 0.04 | 10.19 |
| 7 | 37.320 | 37.280 | 0.040 | 4.000 | 3.91 | 3.87 | 0.04 | 10.08 |
| 8 | 37.280 | 37.237 | 0.043 | 4.300 | 3.90 | 3.86 | 0.04 | 10.03 |
| 9 | 37.237 | 37.203 | 0.034 | 3.400 | 3.88 | 3.85 | 0.03 | 9.96 |
| 10 | 37.203 | 37.160 | 0.043 | 4.300 | 3.87 | 3.84 | 0.03 | 9.91 |
| 11 | 37.160 | 37.128 | 0.032 | 3.200 | 3.85 | 3.84 | 0.01 | 9.86 |
| 12 | 37.128 | 37.085 | 0.043 | 4.300 | 3.84 | 3.82 | 0.02 | 9.78 |
| 13 | 37.085 | 37.049 | 0.036 | 3.600 | 3.84 | 3.81 | 0.03 | 9.75 |
| 14 | 37.049 | 37.018 | 0.031 | 3.100 | 3.83 | 3.80 | 0.03 | 9.70 |
| 15 | 37.018 | 36.982 | 0.036 | 3.600 | 3.81 | 3.79 | 0.02 | 9.63 |
| 16 | 36.982 | 36.949 | 0.033 | 3.300 | 3.80 | 3.78 | 0.02 | 9.58 |
| 17 | 36.949 | 36.910 | 0.039 | 3.900 | 3.80 | 3.78 | 0.02 | 9.58 |
| 18 | 36.910 | 36.874 | 0.036 | 3.600 | 3.78 | 3.78 | 0.00 | 9.53 |
| 19 | 36.874 | 36.839 | 0.035 | 3.500 | 3.78 | 3.76 | 0.02 | 9.48 |
| 20 | 36.839 | 36.810 | 0.029 | 2.900 | 3.78 | 3.76 | 0.02 | 9.48 |
| 21 | 36.810 | 36.775 | 0.035 | 3.500 | 3.76 | 3.75 | 0.01 | 9.4 |
| 22 | 36.775 | 36.744 | 0.031 | 3.100 | 3.76 | 3.75 | 0.01 | 9.4 |
| 23 | 36.744 | 36.707 | 0.037 | 3.700 | 3.76 | 3.74 | 0.02 | 9.37 |
| 24 | 36.707 | 36.678 | 0.029 | 2.900 | 3.75 | 3.74 | 0.01 | 9.35 |
| 25 | 36.678 | 36.642 | 0.036 | 3.600 | 3.74 | 3.74 | 0.00 | 9.33 |
| 26 | 36.642 | 36.613 | 0.029 | 2.900 | 3.74 | 3.73 | 0.01 | 9.30 |
| 27 | 36.613 | 36.577 | 0.036 | 3.600 | 3.74 | 3.72 | 0.02 | 9.27 |

-continued

| Serial number | Mass before inhalation g | Mass after inhalation g | Weight difference g | Mass of each puff mg | Initial voltage V | End voltage V | Voltage difference V | Power W |
|---|---|---|---|---|---|---|---|---|
| 28 | 36.577 | 36.550 | 0.027 | 2.700 | 3.72 | 3.70 | 0.02 | 9.18 |
| 29 | 36.550 | 36.515 | 0.035 | 3.500 | 3.72 | 3.70 | 0.02 | 9.18 |
| 30 | 36.515 | 36.491 | 0.024 | 2.400 | 3.72 | 3.69 | 0.03 | 9.15 |
| 31 | 36.491 | 36.458 | 0.033 | 3.300 | 3.70 | 3.67 | 0.03 | 9.05 |
| 32 | 36.458 | 36.432 | 0.026 | 2.600 | 3.68 | 3.66 | 0.02 | 9.0 |
| 33 | 36.432 | 36.400 | 0.032 | 3.200 | 3.67 | 3.64 | 0.03 | 8.90 |
| 34 | 36.400 | 36.375 | 0.025 | 2.500 | 3.66 | 3.62 | 0.04 | 8.83 |
| 35 | 36.375 | 36.344 | 0.031 | 3.100 | 3.62 | 3.61 | 0.01 | 8.71 |
| 36 | 36.344 | 36.322 | 0.022 | 2.200 | 3.61 | 3.58 | 0.03 | 8.61 |
| 37 | 36.322 | 36.292 | 0.030 | 3.000 | 3.58 | 3.56 | 0.02 | 8.49 |
| 38 | 36.292 | 36.273 | 0.019 | 1.900 | 3.56 | 3.54 | 0.02 | 8.40 |
| 39 | 36.273 | 36.243 | 0.030 | 3.000 | 3.55 | 3.51 | 0.04 | 8.30 |
| 40 | 36.243 | 36.226 | 0.017 | 1.700 | 3.50 | 3.46 | 0.04 | 8.07 |

Figure 3:
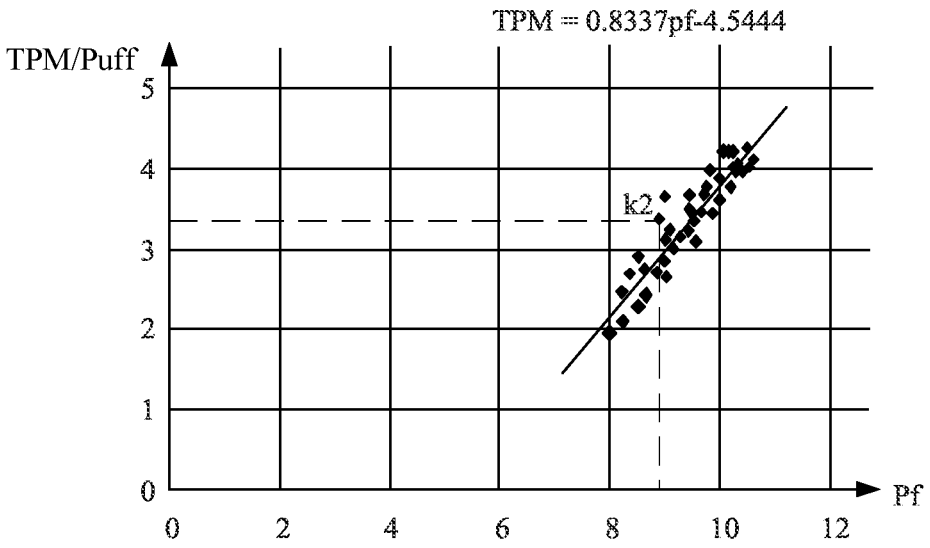
FIG. 3 is a fitting diagram which linearly fits the amount of aerosol generated and the power applied to the vaporization element to acquire a correlation coefficient according to one embodiment.

S233: according to the measurement result of the above table, linearly fitting the mass of each puff expressing the TPM value with the data of the power, as shown in FIG. 3, and then obtaining the linear equation of the fitted curve, which is expressed as TPM=a×Pf+k1, wherein the slope of the equation is the correlation coefficient a of this example. From the linear correlation curve shown in FIG. 3, the power is basically positively correlated to the generated TPM value, which also suits the actual condition in normal inhalation. The higher the power, the greater the amount of the aerosol generated.

S34: in order to improve the accuracy of the correlation coefficient a, in embodiments the above steps S231-S233 can be repeated for testing at different air flow velocities Vt, and the average slope of all the fitted linear equations is taken as the correlation coefficient a, and meanwhile the obtained average intercept of the linear equation is taken as the K1.

Further, in another embodiment, for a given aerosol generation system, the correction constant k can also be measured through detection, and hereinbelow is provided a process in a specific embodiment to detect the correction constant k of an atomization device 10 which is manufactured and prepared, which includes:

S231*a*: performing inhalation at a constant power, for example, 10 w, wherein in a specific example the air flow inhalation velocity increases from 10 ml/s to 50 ml/s, the process of inhalation includes 5 puffs at each air flow velocity and each puff lasts 3 s, then detecting the mass reduction of the atomization device 10 between before and after each process of inhalation, which is the amount of aerosol generated. The results are as the following table:

| Flow velocity | ml/s | 10 | 15 | 20 | 25 | 30 | 35 | 40 | 45 | 50 |
|---|---|---|---|---|---|---|---|---|---|---|
| TPM | mg | 10.21 | 13.37 | 16.35 | 18.26 | 20.04 | 21.53 | 22.52 | 23.49 | 24.41 |
| Mass of each puff | mg | 2.042 | 2.674 | 3.27 | 3.652 | 4.008 | 4.306 | 4.504 | 4.698 | 4.882 |

Figure 4:
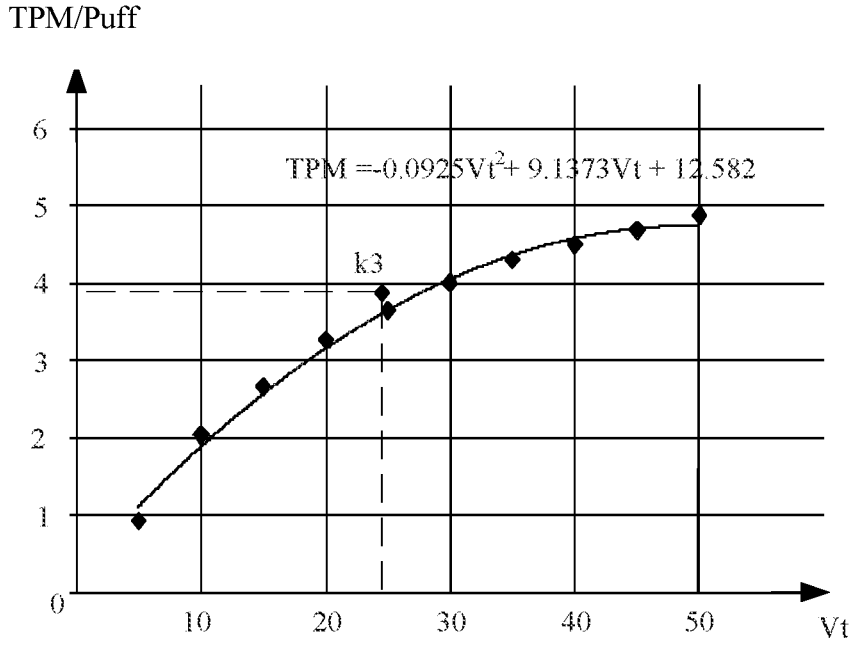
FIG. 4 is a curve obtained by analyzing data results of the amount of aerosol generated at different air flow velocities under a constant power according to one embodiment.

S232*a*: constructing a curve from the data in the table above and finding the curve equation, to obtain a quadratic curve as shown in FIG. 4. By analyzing the obtained curve, it is found that the variation relationship is consistent with the trend of the actual inhalation. In an early velocity increase stage of the actual inhalation, the higher the air flow inhalation velocity, the greater the infiltration speed of the capillary core 12, and the utilization of heat increases gradually, thus the formed TPM amount increases correspondingly; however, after the air flow velocity exceeds a maximum value, on one hand the infiltration speed of the capillary core 12 cannot increase unlimitedly, and on the other hand a limited heat is generated by the heating element 3 at a preset power; the convection cooling caused by air flow further reduces the utilization of heat, thus the amount of aerosol is reduced correspondingly.

S233*a*: in order to improve the accuracy of the above data, the above steps S231*a*-S232*a* can be repeated at more normal powers (8-10 W) to average the three constants of the above two quadratic equations to obtain an average binomial of coefficient, which is TPM=AVt2+BVt+C.

S234*a*: according to the average binomial relation obtained in S233*a*, calculating the average number k2 of the TPM value at the optimal air flow velocity range (20-30 ml/s) of the normal inhalation, as shown in FIG. 3; and calculating the TPM value at the optimal power range according to the formula in S234 and the power range in S233 and taking an average K3, as shown in FIG. 4; then calculating the difference between the two values: Δk=k3−k2, and the difference value Δk is incorporated into k1 as a compensation value, that is, k=k1+Δk; finally, a calculation equation is obtained that can accurately estimate the total TPM in the inhalation process, after the power correlation coefficient a is used to estimate the TPM value, which then is modified by the airflow related correction constant K. TPM=a×Pf+k.

Of course, the difference value of the K3 and K2 is incorporated into k1 as a compensation value to obtain the correction constant k in the present embodiment is an approximate empirical algorithm; in order to obtain the correction constant k in a more accurate formula or mathematical way, one can build a normal distribution diagram of TPM values within an air flow velocity range after testing more air flow velocities, build a mathematical model with an expected value of normal distribution and the above K1 value to analyze to obtain the relation of the two and then calculate the k value according to the relation more accurately.

Therefore, the above correction constant k can be used to modify the amount of aerosol generated per unit time. Finally, since the above correlation coefficient a and the correction constant k of the atomization device 10 can be measured after the atomization device 10 is produced and the liquid substrate is filled in, in one embodiment the information about the above correlation coefficient a and the correction constant k that are measured can be stored in the information memory unit 17, and subsequently the information acquisition unit 23 can acquire the coefficient by acquiring the information.

In order to further validate the accuracy of the amount of aerosol generated of the above calculation process, a validation is performed in one embodiment. The process of validation includes performing inhalation tests on the atomization device 10 for which the correlation coefficient a and the correction constant are obtained through the calculations shown in FIG. 3 and FIG. 4, and calculating the consumption of the liquid substrate according to the formula of $M_{consumption}$ after each process of inhalation, meanwhile measuring the weight difference between before and after the inhalation, and finally validating the data accuracy of the consumption obtained through the formula and the weight difference.

Test 1: Random Inhalation Test

During the process of this detection, the inhalation test is simulated with a user's normal inhalation state, the specific inhalation simulation includes 5 processes of inhalation, each process of inhalation includes 5 puffs, the inhalation time generally lasts 2-4 s in each puff, and in the inhalation the air flow velocity is within a normal range of 15~35 ml/s, make sure the inhalation action neither too strong nor too weak, and the following table shows the consumption and the weight difference obtained through the formula and weighing respectively.

| Process of inhalation | Calculated consumption M1 | Weight difference M2 | (M1 − M2)/M1 |
|---|---|---|---|
| 1 | 13.5 mg | 12.8 mg | 5.18% |
| 2 | 18.4 mg | 17.9 mg | 2.71% |
| 3 | 16.8 mg | 15.6 mg | 7.14% |
| 4 | 15.5 mg | 14.3 mg | 7.74% |
| 5 | 16.4 mg | 15.7 mg | 4.26% |

According to the comparison between the estimated consumption and the weight difference, the data is relatively close; therefore, the above estimation method can be used as the detection of consumption.

It is to be noted that the description and the accompanying drawings of the present disclosure just illustrate some preferred embodiments of the present disclosure, but are not limited to the embodiments described in the description; further, for the ordinary staff in the art, improvements or transformations can be made according to the above description, and these improvements and transformations are intended to be included in the scope of protection of claims appended hereinafter.

The invention claimed is:

1. An aerosol generation system, comprising:

a liquid storage cavity, which is configured for storing a liquid matrix;

a vaporization element, which is configured for vaporizing the liquid matrix to form an aerosol for a user to inhale;

a battery cell, which is configured for providing a power to the vaporization element;

an air flow sensor, which is configured for measuring an air flow velocity formed by user inhalation passing through the aerosol generation system; and a controller, which is configured for determining the consumption of the liquid matrix in a time period on the basis of the power applied to the vaporization element, the air flow velocity, a correlation coefficient and a correction constant in the time period; wherein the correlation coefficient is a coefficient of correlation between the power applied to the vaporization element and the amount of aerosol generated, and the correction constant is a modified value for correlation between the air flow velocity passing through the aerosol generation system and the amount of aerosol generated.

2. The aerosol generation system according to claim 1, wherein the time period comprises multiple unit time lengths;

the controller is configured for:

calculating the air flow passing through the aerosol generation system per unit time length through the air flow velocity;

calculating the amount of aerosol generated in the unit time length through the power applied to the vaporization element, the correlation coefficient and the correction constant in the unit time length; and calculating the consumption of the liquid matrix in the time period through the amount of aerosol generated and the air flow in the unit time length.

3. The aerosol generation system according to claim 1, wherein the controller is configured for determining the consumption of the liquid matrix in the time period according to the following formula:

$$M_{consumption} = \sum_{t=0}^{n} \binom{n}{t} [(a \times Pf + k) \times Vt \times S],$$

where $M_{consumption}$ is the consumption of the liquid matrix in the time period, Pf is the power applied to the vaporization element in a unit time length, a is the correlation coefficient, k is the correction constant, Vt is the air flow velocity passing through the aerosol generation system, S is a constant, t is time, n is a number of unit time lengths included in the time period.

4. The aerosol generation system according to claim 1, wherein the controller is further configured for estimating the remaining amount of the liquid matrix inside the liquid storage cavity on the basis of the determined consumption of the liquid matrix.

5. The aerosol generation system according to claim 4, wherein the controller is configured for estimating the remaining amount of the liquid matrix inside the liquid storage cavity by subtracting the consumption from the known initial amount of the liquid matrix stored in the liquid storage cavity.

6. The aerosol generation system according to claim 1, further comprising:

an information memory unit, which stores calculation constant information, the calculation constant information comprising the correlation coefficient information and the correction constant information; and an information acquisition unit, which is configured for receiving the calculation constant information stored in the information memory unit and thus acquiring the correlation coefficient or the correlation constant.

7. The aerosol generation system according to claim 6, wherein the correlation coefficient information comprises the correlation coefficient or a physical and chemical parameter of the liquid matrix associated to the correlation coefficient; and the information acquisition unit is configured for receiving the correlation coefficient information and thus acquiring the correlation coefficient or the physical and chemical parameter of the liquid matrix associated to the correlation coefficient.

8. The aerosol generation system according to claim 7, wherein the controller stores a comparison table between the correlation coefficient and the physical and chemical parameter of the liquid matrix, and is configured for retrieving the correlation coefficient from the comparison table according to the physical and chemical parameter of the liquid matrix.

9. The aerosol generation system according to claim 7, wherein the physical and chemical parameter comprises at least one of the substance composition, viscosity, specific heat or vaporization efficiency of the liquid matrix.

10. The aerosol generation system according to claim 7, wherein the information memory unit comprises at least one of EPROM, EEPROM, NFC label, bar code and QR code.

11. The aerosol generation system according to claim 6, wherein the information memory unit further stores the known initial amount of the liquid matrix stored in the liquid storage cavity.

12. The aerosol generation system according to claim 1, further comprising an output device, which is configured for indicating the consumption of the liquid matrix in the time period or presenting the remaining amount of the liquid matrix inside the liquid storage cavity.

13. The aerosol generation system according to claim 1, wherein the vaporization element comprises at least one heating element, which is configured for heating the liquid matrix to form an aerosol; and the aerosol generation system further comprises: a capillary core, which is configured for conveying the liquid matrix to the heating element from the liquid storage cavity.

14. A measurement method of an aerosol generation system for consumption of a liquid matrix, wherein the aerosol generation system comprises:

a liquid storage cavity, which is configured for storing a liquid matrix;

a vaporization element, which is configured for vaporizing the liquid matrix to form an aerosol for a user to inhale;

a battery cell, which is configured for providing a power to the vaporization element;

an air flow sensor, which is configured for measuring an air flow velocity formed by user inhalation passing through the aerosol generation system; and wherein the method comprises a step of: determining the consumption of the liquid matrix in a time period on the basis of the power applied to the vaporization element, the air flow velocity, a correlation coefficient and a correction constant in the time period; wherein the correlation coefficient is a coefficient of correlation between the power applied to the vaporization element and the amount of aerosol generated, and the correction constant is a modified value for correlation between the air flow velocity passing through the aerosol generation system and the amount of aerosol generated.

15. The measurement method of the aerosol generation system for consumption of the liquid matrix according to claim 14, wherein the time period comprises multiple unit time lengths; and the method comprises:

calculating the air flow passing through the aerosol generation system per unit time length through the air flow velocity;

calculating the amount of aerosol generated in the unit time length through the power applied to the vaporization element, the correlation coefficient and the correction constant in the unit time length; and calculating the consumption of the liquid matrix in the time period through the vaporization amount of the liquid matrix and the air flow in the unit time length.

16. The measurement method of the aerosol generation system for consumption of the liquid matrix according to claim 15, wherein the method comprises:

determining the consumption of the liquid matrix in the time period according to the following formula:

$$M_{consumption} = \sum_{t=0}^{n} \binom{n}{t} [(a \times Pf + k) \times Vt \times S],$$

where $M_{consumption}$ is the consumption of the liquid matrix in the time period, Pf is the power applied to the vaporization element in a unit time length, a is the correlation coefficient, k is the correction constant, Vt is the air flow velocity passing through the aerosol generation system, S is a constant, t is time, n is a number of unit time lengths included in the time period.

17. The measurement method of the aerosol generation system for consumption of the liquid matrix according to claim 14, wherein the aerosol generation system further comprises an information memory unit which stores calculation constant information, the calculation constant information comprising at least one of the correlation coefficient information or the correction constant information; and the method comprises: receiving the calculation constant information stored in the information memory unit and thus acquiring the correlation coefficient or the correlation constant.

18. The measurement method of the aerosol generation system for consumption of the liquid matrix according to claim 17, wherein the correlation coefficient information comprises the correlation coefficient or a physical and chemical parameter of the liquid matrix associated to the correlation coefficient; and the method comprises:

receiving the correlation coefficient information stored in the information memory unit and thus acquiring the correlation coefficient; or receiving the correlation coefficient information stored in the information memory unit and thus acquiring the physical and chemical parameter of the liquid matrix associated to the correlation coefficient, and deducing the correlation coefficient according to the physical and chemical parameter of the liquid matrix.

19. The measurement method of the aerosol generation system for consumption of the liquid matrix according to claim 18, wherein the physical and chemical parameter of the liquid matrix comprises at least one of the substance composition, viscosity, specific heat, boiling point or vaporization efficiency of the liquid matrix.

20. An atomization device, comprising:

a liquid storage cavity, which is configured for storing a liquid matrix;

a vaporization element, which is configured for vaporizing the liquid matrix when a power is applied, so to form an aerosol for a user to inhale;

an air flow sensor, which is configured for measuring an air flow velocity formed by user inhalation passing through the atomization device; and an information memory unit, which stores calculation constant information, the calculation constant information comprising correlation coefficient information and correction constant information; wherein by receiving the calculation constant information stored in the information memory unit, the correlation coefficient or the correlation constant can be acquired, thus the consumption of the liquid matrix in a time period can be determined according to the power applied to the vaporization element, the air flow velocity, the correlation coefficient and the correction constant in the time period; wherein the correlation coefficient is a coefficient of correlation between the power applied to the vaporization element and the amount of aerosol generated, and the correction constant is a modified value for correlation between the air flow velocity passing through the atomization device and the amount of aerosol generated.

* * * * *